US010519757B2

(12) United States Patent
Graff, Jr. et al.

(10) Patent No.: US 10,519,757 B2
(45) **Date of Patent: *Dec. 31, 2019**

(54) MULTI-DIRECTIONAL ENHANCED OIL RECOVERY (MEOR) METHOD

(71) Applicants: Frank Thomas Graff, Jr., Charleston, WV (US); Reuben L. Graham, Charleston, WV (US); William J. Maloney, Davidson, NC (US)

(72) Inventors: Frank Thomas Graff, Jr., Charleston, WV (US); Reuben L. Graham, Charleston, WV (US); William J. Maloney, Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/056,901

(22) Filed: Aug. 7, 2018

(65) Prior Publication Data

US 2018/0340404 A1 Nov. 29, 2018

Related U.S. Application Data

(63) Continuation-in-part of application No. 15/427,780, filed on Feb. 8, 2017, now Pat. No. 10,066,469.
(Continued)

(51) Int. Cl.
*E21B 43/16* (2006.01)
*E21B 43/20* (2006.01)

(52) U.S. Cl.
CPC ..... *E21B 43/166* (2013.01); *E21B 43/164* (2013.01); *E21B 43/20* (2013.01)

(58) Field of Classification Search
CPC ..... E21B 43/166; E21B 43/164; E21B 43/20
(Continued)

(56) References Cited

U.S. PATENT DOCUMENTS 1,651,311 A * 11/1927 Atkinson ..... C09K 8/58 166/275
3,065,790 A 11/1962 Holm
(Continued)

FOREIGN PATENT DOCUMENTS

CA 1285747 C 7/1991
CA 1303973 C 6/1992
(Continued)

*Primary Examiner* — Taras P Bemko
(74) *Attorney, Agent, or Firm* — Thomas | Horstemeyer, LLP

(57) ABSTRACT

Methods for multi-directional enhanced oil recovery (MEOR) are disclosed that involve removal of oil from a reservoir that has an injection well, a producing well, and a plurality of lenses that contain oil and that each span between the injection well and the producing well. One method, among others, involves recovering primary oil from a primary set of lenses via the producing well by alternating injection one or more times of water and an injection gas, or IG (e.g., carbon dioxide, ethane, natural gas, nitrogen, etc., or any combination thereof) into the injection well so that the water and IG enter the primary set in a first direction and move the primary oil in the first direction. The method further involves recovering secondary oil from a secondary set of lenses that is different than the primary set via the injection well by alternating injection one or more times of water and the IG into the producing well so that the water and carbon dioxide enter the secondary set in a second direction that is different than the first direction (e.g., opposite) and therefore move the secondary oil in the second direction.

11 Claims, 5 Drawing Sheets

Related U.S. Application Data

(60) Provisional application No. 62/293,056, filed on Feb. 9, 2016.

(58) Field of Classification Search
USPC ..... 166/402
See application file for complete search history.

(56) References Cited

U.S. PATENT DOCUMENTS

| | | | | |
|---|---|---|---|---|
| 3,101,782 | A | 8/1963 | Holm | |
| 4,415,032 | A | 11/1983 | Shu | |
| 4,609,043 | A | 9/1986 | Cullick | |
| 4,683,948 | A | 8/1987 | Fleming | |
| 4,819,724 | A * | 4/1989 | Bou-Mikael | E21B 43/16 166/266 |
| 5,358,043 | A * | 10/1994 | Moradi-Araghi | C09K 8/887 166/270 |
| 5,915,477 | A | 6/1999 | Stuebinger et al. | |
| 8,413,718 | B2 | 4/2013 | Morrow et al. | |
| 2008/0196892 | A1* | 8/2008 | Lau | C09K 8/582 166/268 |
| 2011/0220359 | A1* | 9/2011 | Soliman | C09K 8/588 166/305.1 |
| 2014/0338903 | A1 | 11/2014 | Mahmoud et al. | |
| 2016/0061020 | A1* | 3/2016 | Sayarpour | E21B 43/14 166/250.01 |

FOREIGN PATENT DOCUMENTS

| | | | |
|---|---|---|---|
| CA | 2718666 | A1 | 10/2009 |
| EP | 1258595 | A2 | 11/2002 |

* cited by examiner

MULTI-DIRECTIONAL ENHANCED OIL RECOVERY (MEOR) METHOD

CLAIM OF PRIORITY

This application is a continuation-in-part (CIP) of application Ser. No. 15/427,780, filed on Feb. 8, 2017, now U.S. Pat. No. 10,066,469, which claims the benefit of and priority to application No. 62/293,056 filed Feb. 9, 2016. All of the foregoing applications are incorporated herein by reference in its entirety.

FIELD OF INVENTION

The present disclosure generally relates to enhanced oil recovery (EOR) involving removal of oil from a reservoir that has at least one injection well and at least one producing well.

BACKGROUND OF THE INVENTION

Traditional methods of enhanced oil recovery include gas, thermal, and chemical injection techniques. Gas injection, commonly utilizing injection of carbon dioxide (C02) through a series of boreholes, allows for oil recovery from adjacent recovery wells. In its traditional form, EOR is based on the use of recognized basic tenants of physics: first, oil formations are composed of multiple, irregular lenses retaining oil which combine to form formations and reservoirs; second, depending on viscosity, all fluids seek the path of least resistance when traveling through an oil formation; and third, water is not miscible with oil and has a higher viscosity than a gas like C02; fourth, C02 is miscible with oil and will interact with and energize oil in formation; and fifth, C02 has the ability to travel through numerous lenses within a formation that water will not initially enter.

Conventional and traditional methods of EOR will "water flood" first by entering all oil lenses that will accept water. As a result, lenses into which water can enter will have the oil partially pushed out of the lens and replaced with water. C02 is then injected into the reservoir. It will bypass the water filled lenses and seek another lens with less resistance. The C02 will energize the oil in the new lens and promote movement of the oil out of the lens. Subsequently, water will be injected behind the C02 to push everything out of the lens, leaving the lens filled with water. This procedure will be repeated to maximize the recovery of oil from the reservoir until such time as the results no longer yield economic favor.

SUMMARY OF THE INVENTION

The present disclosure provides various methods for multi-directional enhanced oil recovery (MEOR). The MEOR methods are a novel refinement over the traditional methods of enhanced oil recovery (EOR).

One embodiment, among others, is a method for enhanced oil recovery that involves removal of oil from a reservoir that has an injection well, a producing well, and a plurality of lenses that contain oil and that each span between the injection well, and the producing well. The method involves recovering primary oil from a primary set of lenses via the producing well by alternating injection one or more times of water and an injection gas, or IG (e.g., carbon dioxide (CO2) gas, ethane gas, natural gas, nitrogen gas, etc.) into the injection well so that the water and the IG enter the primary set in a first direction and move the primary oil in the first direction. The method further involves recovering secondary oil from a secondary set of lenses that is different than the primary set via the injection well by alternating injection one or more times of water and the IG into the producing well so that the water and the IG enter the secondary set in a second direction that is different than the first direction (e.g., opposite direction) and move the secondary oil in the second direction.

Another embodiment, among others, is a method for enhanced oil recovery involving removal of oil from a reservoir that has an injection well, a producing well, and a plurality of lenses that contain oil and that each span between the injection well, and the producing well. This method can be summarized by the following steps: (a) recovering primary oil from the producing well by injecting water into the injection well and then into a primary set of the lenses; (b) recovering secondary oil from the producing well by injecting the IG into the injection well and then into a secondary set of the lenses, the secondary set being different than the primary set; (c) recovering more of the secondary oil from the producing well by injecting water into the injection well and then into the secondary set of the lenses; and (d) recovering tertiary oil from the injection well by injecting the IG into the producing well and then into a tertiary set of the lenses, the tertiary set being different than the primary and secondary sets of lenses.

Yet another embodiment, among others, is a method for enhanced oil recovery involving removal of oil from a reservoir that has an injection well, a producing well, and a plurality of lenses that contain oil and that each span between the injection well, and the producing well. This method can be summarized by the following steps: (a) recovering primary oil from the producing well by injecting water into the injection well and then into a primary set of the lenses; (b) recovering secondary oil from the producing well by injecting IG into the injection well and then into a secondary set of the lenses, the secondary set being different than the primary set; (c) recovering more secondary oil from the producing well by introducing more water into the injection well; (d) repeating steps (b) and (c) one or more times; (e) recovering tertiary oil from the injection well by injecting IG into the producing well and then into a tertiary set of the lenses, the tertiary set being different than the primary and secondary sets of lenses; (f) recovering tertiary oil from the injection well by injecting water into the producing well; and (g) repeating steps (e) and (f) one or more times.

Other embodiments, apparatus, devices, features, characteristics, advantages, and methods of the present invention will become more apparent in the Detailed Description of Invention section and accompanying drawings and claims, all of which form a part of this specification.

BRIEF DESCRIPTION OF DRAWINGS

The various embodiments and features of the invention will be clearly depicted in the following drawings. The elements in the drawings are not necessarily to scale, emphasis instead being placed upon clearly illustrating the principles of the embodiments of the present disclosure.

DETAILED DESCRIPTION OF INVENTION

The present disclosure provides a method for multi-directional enhanced oil recovery (MEOR). MEOR is a novel refinement over the traditional methods of enhanced oil recovery (EOR). The MEOR method can be used with existing facilities, such as an existing injection well(s) and an existing producing well(s), or with newly designed wells. Furthermore, the wells can extend in a vertical direction, horizontal direction, other direction, or combinations thereof.

Figure 1:
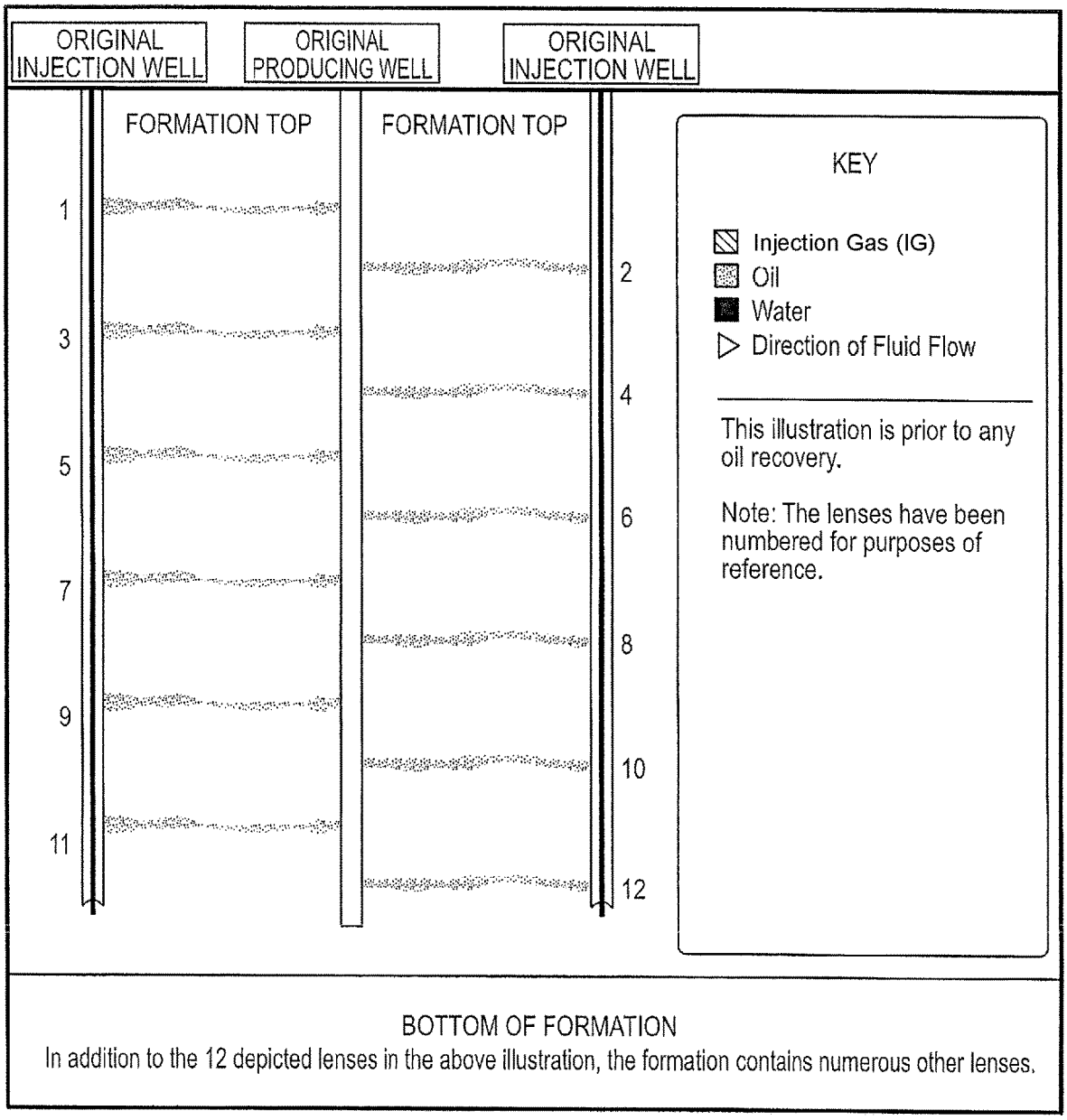
FIG. 1 is perspective concept view of the reservoir prior to any oil recovery using the MEOR method of the present disclosure.

An embodiment, among others, of the MEOR method of the present disclosure will now be described. FIG. 1 is perspective concept view of the reservoir prior to any oil recovery. This example shows a reservoir with two substantially vertical injection wells and one substantially vertical producing well. FIG. 1 also shows 12 substantially horizontal lenses that span between one of the injection wells and the producing well. These lenses may or may not have oil in them. In this example, all 12 of the lenses are shown with oil in them.

Figure 2:
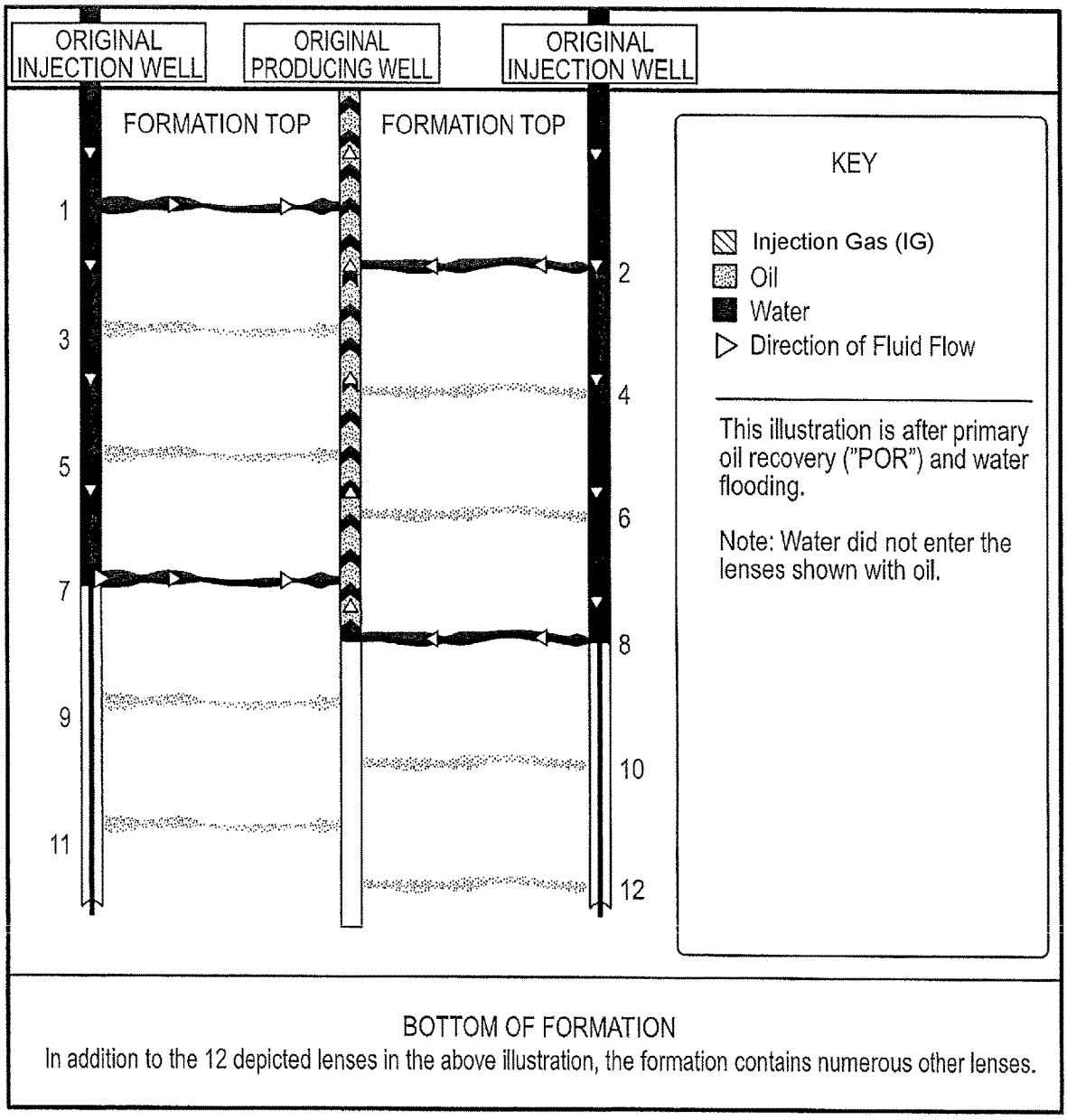
FIG. 2 is a perspective concept view of the reservoir after primary oil recovery (POR) and water flooding, in accordance with the MEOR method of the present disclosure.

As shown in FIG. 2, the first step of the MEOR method is to flood, or inject, with water the lenses that will accept water by injecting the water into the injection wells to thereby force a mixture of oil and water to the surface through the producing well. After extraction of the oil/water mixture, the oil is separated from the water using well known techniques and equipment. This process is sometimes referred to in the industry as primary oil recovery (POR). Further, the apparatus for channeling and introducing water into the injection wells is also well known in the art. Note that water does not enter all of the lenses during this process. As illustrated in FIG. 2, in this example, the water entered lenses 1, 2, 7, and 8, but failed to enter lenses 3-6 and 9-12, which still have oil in them.

Figure 3:
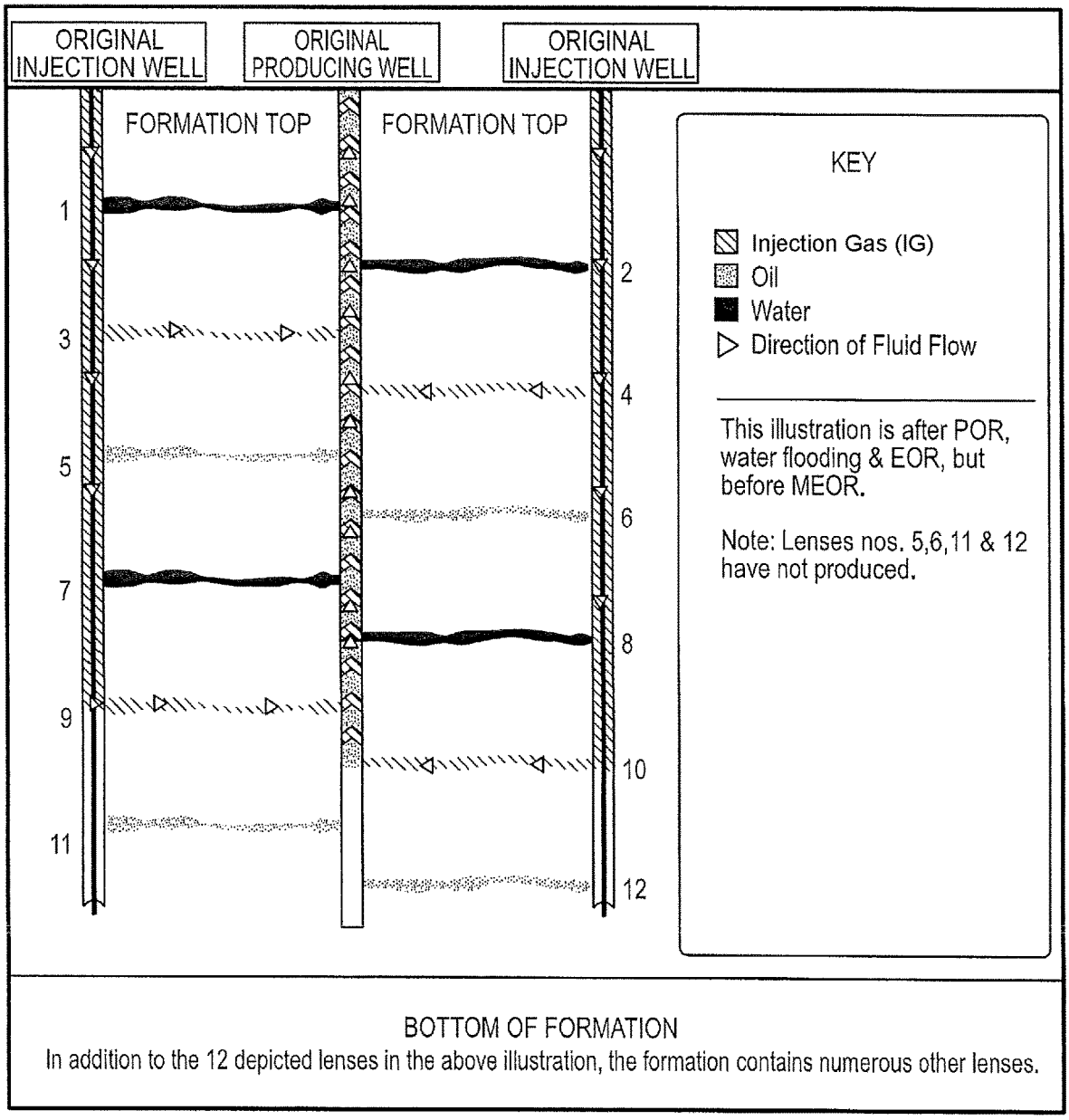
FIG. 3 is a perspective concept view of the reservoir after POR, water flooding, and EOR, in accordance with the MEOR method of the present disclosure.

FIG. 3 illustrates the next step of the MEOR method of the present disclosure. In this step, an injection gas (IG; e.g., carbon dioxide (CO2) gas, ethane (C2H6) gas, natural gas, nitrogen (N2) gas, etc., or any combination thereof and with or without other gases) is injected into the reservoir via the injection wells. The apparatus for channeling and introducing IG into the injections wells is well known in the art. As illustrated in FIG. 3, the IG enters some of the lenses, particularly, lenses 3, 4, 9, and 10, that were not penetrated by the water in the previous step, thereby forcing a mixture of IG and oil from these lenses to the surface through the producing well. After extraction of this oil/IG mixture, the oil is separated from the IG using well known techniques and equipment. Water is then injected behind the C02 to push the IG as well as more oil out of the lenses, leaving the lenses 3, 4, 9, and 10 where oil was removed filled with water. This procedure of flooding the lenses with water and then injecting IG is repeated to maximize the recovery of oil from the reservoir until such time as the results become no longer economical. So, after this process, there are still some lenses, particularly, lenses 5, 6, 11, and 12, that contain oil and could not be penetrated by the water and IG injections.

Figure 4:
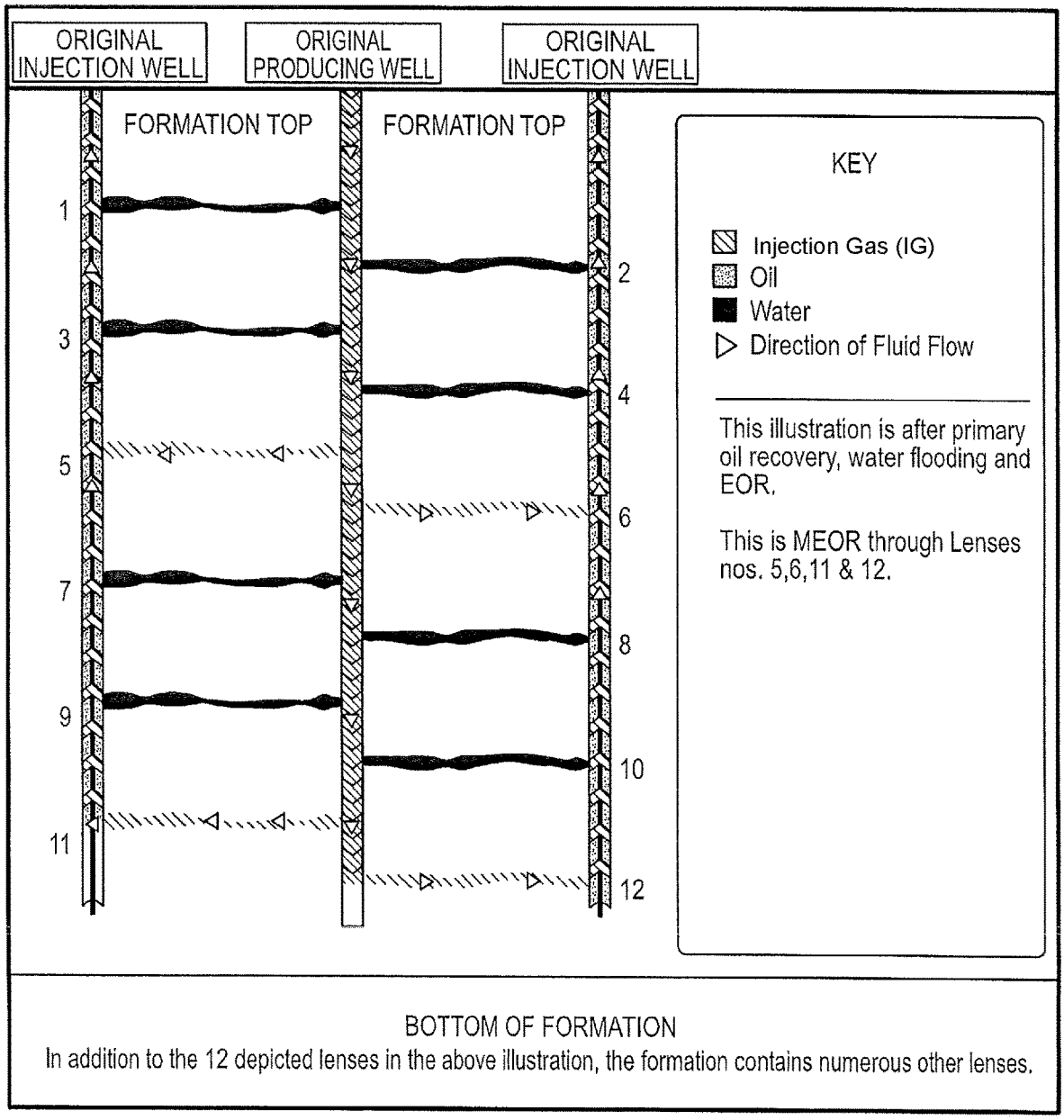
FIG. 4 is a perspective concept view of the reservoir after primary oil recovery, water flooding, EOR, and injection of an injection gas, or IG (e.g., carbon dioxide (CO2) gas, ethane gas, natural gas, nitrogen gas, etc., or any combination thereof) in a reverse direction, in accordance with the MEOR method of the present disclosure.

When results are no longer economically favorable, the direction of the injected C02 and injected water is changed in accordance with the MEOR method of the present disclosure. FIG. 4 is a perspective concept view of the reservoir showing the IG part of the MEOR method. More specifically, IG is injected into the producing well (as opposed to the injection wells) so that IG attempts to enter the lenses from the opposite direction than before. During this step, IG will penetrate some of the lenses that could not be penetrated from the other direction. As shown in FIG. 4, in this example, IG is able to penetrate lenses 5, 6, 11, and 12, which could not be penetrated before. Oil is recovered from the injection wells from lenses 5, 6, 11, and 12. Water is then injected into the producing well to enter the lenses in the opposite direction in order to retrieve more oil and displace the IG in these lenses, and the foregoing process is repeated until the recovery of oil is no longer economical.

Figure 5:
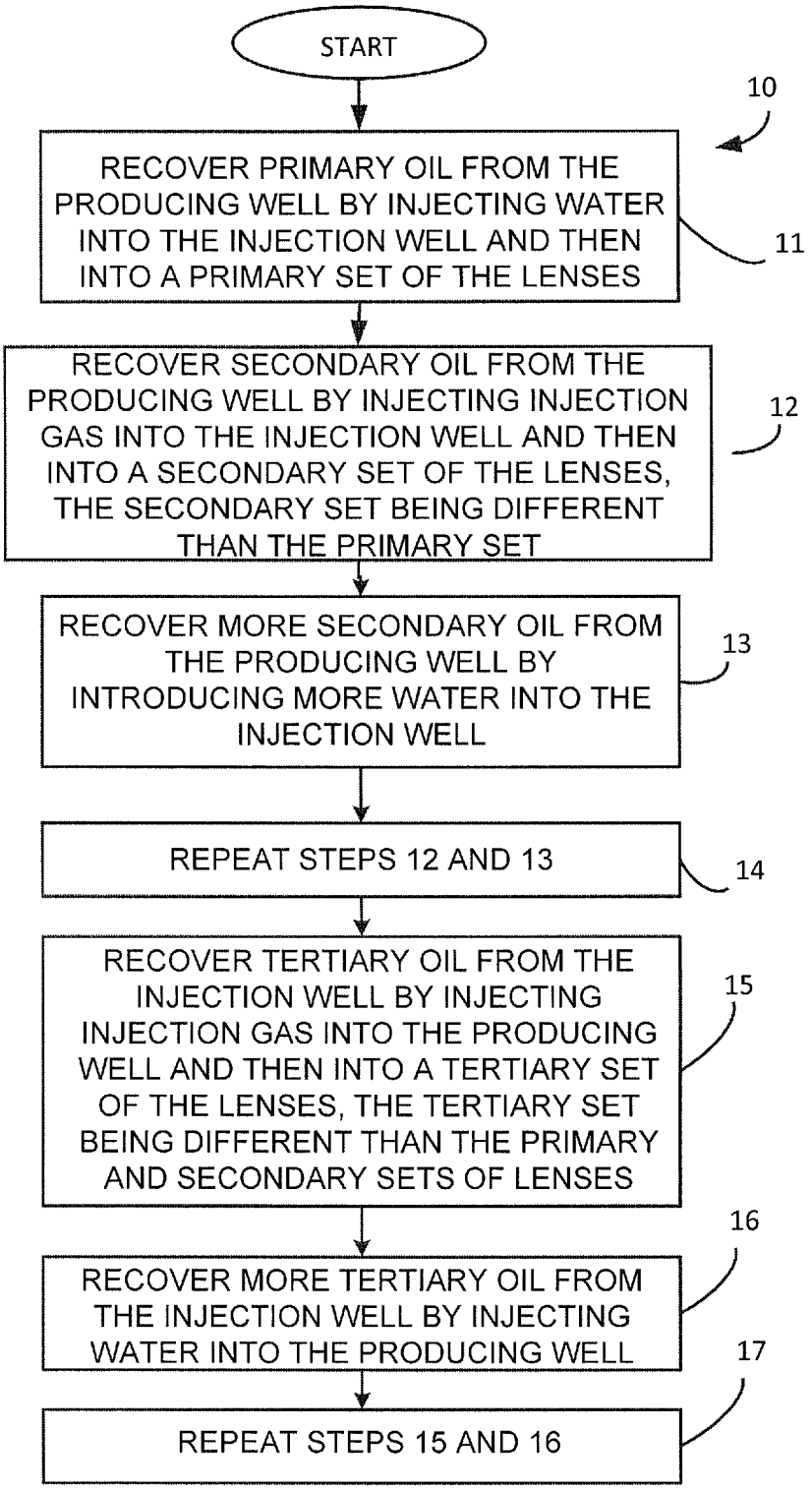
FIG. 5 is a flowchart showing an embodiment of the MEOR method of the present disclosure.

FIG. 5 is a flowchart summarizing an embodiment 10, among others, of the MEOR method of the present disclosure. As shown at reference numeral 11, primary oil is recovered from the producing well by injecting water into the injection well and then into a primary set of the lenses. Then, as indicated at reference numeral 12, secondary oil is recovered from the producing well by injecting carbon dioxide into the injection well and then into a secondary set of the lenses, the secondary set being different than the primary set. Next, more secondary oil is recovered from the producing well by introducing more water into the injection well. The steps denoted by reference numerals 12 and 13 are repeated one or more times, as indicated at reference numeral 14, until the oil yield becomes low. Then, as shown at reference numeral 15, tertiary oil is recovered from the injection well by injecting carbon dioxide into the producing well and then into a tertiary set of the lenses. The tertiary set is different than the primary and secondary sets of lenses. Further, as illustrated at reference numeral 16, more tertiary oil is recovered from the injection well by injecting water into the producing well. Finally, at reference numeral 17, steps 15 and 16 are repeated one or more times, until the oil yield becomes low.

By utilizing this very efficient method of oil recovery, it is estimated that oil yields can be boosted to levels up to ten (10%) percent as compared to existing traditional methods.

Another advantage of the MEOR method is the improved utilization of existing infrastructure as well as profitably by adding inexpensive additional steps.

It should be emphasized that the above-described embodiments of the present disclosure are merely possible non-limiting examples of implementations, merely set forth for a clear understanding of the principles of the invention. Many variations and modifications may be made to the above-described embodiments of the present disclosure without departing substantially from the spirit and principles of the present invention. All such modifications and variations are intended to be included herein within the scope of this disclosure.

The invention claimed is:

1. A method for multi-directional enhanced oil recovery (MEOR) involving removal of oil from a reservoir that has an injection well, a producing well, and a plurality of lenses that contain oil and that each span between the injection well, and the producing well, the method comprising:

(a) recovering primary oil from the producing well by injecting water into the injection well and then into a primary set of the lenses;

(b) recovering a first amount of secondary oil from the producing well by injecting injection gas (IG) into the injection well and then into a secondary set of the lenses, the secondary set being different than the primary set;

(c) recovering a second amount of secondary oil from the producing well by introducing more water into the injection well;

(d) repeating steps (b) and (c);

(e) recovering a first amount of tertiary oil from the injection well by injecting IG into the producing well and then into a tertiary set of the lenses, the tertiary set being different than the primary and secondary sets of lenses;

(f) recovering a second amount of tertiary oil from the injection well by injecting water into the producing well;

(g) repeating steps (e) and (f) in order to recover third and fourth amounts of the tertiary oil, respectively; and (h) wherein the IG comprises a gas selected from a group consisting of carbon dioxide, ethane gas, natural gas, nitrogen gas, and any combination thereof.

2. The method of claim 1, wherein the wells are generally vertical.

3. The method of claim 1, wherein the wells are generally horizontal.

4. The method of claim 1, further comprising creating the injection well, the producing well, or both.

5. A method for multi-directional enhanced oil recovery (MEOR) involving removal of oil from a reservoir that has an injection well, a producing well, and a plurality of lenses that contain oil and that each span between the injection well, and the producing well, the method comprising:

(a) recovering primary oil from the producing well by injecting water into the injection well and then into a primary set of the lenses;

(b) recovering a first amount of secondary oil from the producing well by injecting injection gas (IG) into the injection well and then into a secondary set of the lenses, the secondary set being different than the primary set;

(c) recovering a second amount of the secondary oil from the producing well by injecting water into the injection well and then into the secondary set of the lenses;

(d) recovering tertiary oil from the injection well by injecting IG into the producing well and then into a tertiary set of the lenses, the tertiary set being different than the primary and secondary sets of lenses; and (e) wherein the IG comprises a gas selected from a group consisting of carbon dioxide, ethane gas, natural gas, nitrogen gas, and any combination thereof.

6. The method of claim 5, wherein the wells are generally vertical.

7. The method of claim 5, wherein the wells are generally horizontal.

8. The method of claim 5, further comprising creating the injection well, the producing well, or both.

9. The method of claim 5, wherein a first amount of the tertiary oil is recovered in step (d) and further comprising (f) recovering a second amount of the tertiary oil from the injection well by injecting water into the producing well and then into the tertiary set of lenses.

10. The method of claim 9, further comprising repeating steps (d) and (f) in order to recover third and fourth amounts of the tertiary oil, respectively.

11. The method of claim 5, further comprising repeating steps (b) and (c) in order to recover third and fourth amounts of the secondary oil, respectively.

* * * * *